US005288689A

United States Patent [19]

Simpson et al.

[11] Patent Number: 5,288,689

[45] Date of Patent: Feb. 22, 1994

[54] METHOD FOR FUSING THERMAL DYE TRANSFER IMAGES

[75] Inventors: William H. Simpson, Pittsford; Jacob J. Hastreiter, Jr., Spencerport, both of N.Y.

[73] Assignee: Eastman Kodak Company, Rochester, N.Y.

[21] Appl. No.: 34,034

[22] Filed: Mar. 22, 1993

[51] Int. Cl.[5] ..... B41M 5/035; B41M 5/38

[52] U.S. Cl. ..... 503/227; 40/159.2; 427/375; 428/13; 428/14; 428/192; 428/195; 428/412; 428/913; 428/914; 430/200; 430/945

[58] Field of Search ..... 8/471; 40/159.2; 428/13, 14, 192, 195, 412, 913, 914; 503/227; 427/375; 430/200, 945

[56] References Cited

U.S. PATENT DOCUMENTS

| | | | |
|---|---|---|---|
| 5,105,064 | 4/1992 | Kresock | 219/216 |
| 5,143,754 | 9/1992 | Long et al. | 503/227 |
| 5,234,886 | 8/1993 | Sarraf | 503/227 |

*Primary Examiner*—B. Hamilton Hess
*Attorney, Agent, or Firm*—Harold E. Cole

[57] ABSTRACT

A process of fusing a dye-receiving element for thermal dye transfer suitable for forming a slide for projection viewing, the dye-receiving element comprising a polymeric central dye image-receiving section and a polymeric frame section extending around the periphery of the central section, the dye image-receiving section containing a thermally-transferred dye image, the process comprising simultaneously subjecting the element to both conductive and convective heating.

20 Claims, 1 Drawing Sheet

METHOD FOR FUSING THERMAL DYE TRANSFER IMAGES

This invention relates to a method for fusing thermal dye transfer images, and more particularly to fusing images in receiving elements which are suitable for forming a slide for projection viewing.

In recent years, thermal transfer systems have been developed to obtain prints from pictures and images which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. A line-type thermal printing head may be used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the desired image, so that each dye is heated to cause volatilization only in those areas in which its presence is required on the receiver to construct the color of the desired image. Further details of this process are found in GB 2,083,726A, the disclosure of which is hereby incorporated by reference. Additional sources of energy that may be used to thermally transfer dye from a donor to a receiver include light flash and ultrasound.

Thermal dye transfer image prints may be formed on a reflective receiver element in order to provide a color hard copy for reflective viewing. Alternatively, thermal dye transfer images may be formed on a receiver element transparent to visible light. The resulting images are commonly viewed in the transmission mode, as in overhead projection, and such imaged elements are commonly called "overhead transparencies". Transparent thermal dye transfer receivers designed for making transparencies are generally thin, flexible films on the order of about 0.1 to 0.2 mm thick. U.S. Pat. No. 4,833,124, for example, discloses receiver elements comprising a thin dye image-receiving layer on a 0.1 mm thick transparent poly(ethylene terephthalate) film support.

Another possible way of viewing images on transparent supports is "slide" projection, commonly used to view photographic images. Slide transparency images are generally projected with enlargement (e.g. at 100 power magnification) onto a large screen.

Slides offer advantages in storing and viewing transparencies such as ease of handling the images and automated sequencing of images. Slides generally have a much smaller image area than overhead transparencies, however, and with their high image magnification projection require finer detail in order to achieve a projected image of high fidelity.

U.S. Ser. No. 722,810, filed Jun. 19, 1991, now U.S. Pat. No. 5,234,886 of Sarraf et al. discloses a slide for projection viewing comprising a polymeric central dye image-receiving section containing a thermally-transferred image and an integral polymeric frame section extending around the periphery of the central section. Sarraf et al. disclose that after the image is obtained, it is subsequently fused by heating the imaged receiver with radiant energy. This fusing process drives the dyes into the receiver material and serves in this way to protect the image from physical damage, such as abrasion or fading of the dyes. Radiant fusing is also discussed in U.S. Pat. No. 5,105,064.

However, there are problems associated with radiant fusing. The optical density of the image at any point determines the absorption of radiant energy and consequently the rate at which the temperature will rise at that point. Since the dyes are able to absorb more of the incident energy from the radiant fuser than does the polymeric receiver surface, they heat up more rapidly. The polymeric receiver surface then absorbs heat from the dye during this process which means its temperature rise lags behind that of the dye.

The dyes in this process will usually melt between 50° and 100°C. The diffusion of the dyes into the polymeric receiver is usually very slow below the glass transition temperature of the polymer, but increases by several orders of magnitude above that temperature. The glass transition temperature of the polymeric receiver material is usually greater than about 125° C. During heating, if the dyes melt before the glass transition temperature of the polymeric receiver is reached, they have a tendency to undergo surface spreading before diffusion. This phenomenon results in a widening of lines or other sharp edges, especially where the lines or edges are composed of more than one dye and are contiguous with, or superimposed upon, an area of low density.

Alternatively, the slide can be fused after transfer of the dyes by exposing it to the vapors of a solvent for an appropriate time, as described in U.S. Pat. Nos. 4,876,235 and 5,143,754. The vapors permeate the polymer and act as a plasticiser thus lowering the glass transition temperature and allowing the dyes to diffuse into the polymeric material at a higher rate. However, this technique is difficult to control and is not convenient for the operator.

It is an object of this invention to provide a technique for fusing a thermally-transferred image in a slide element which would reduce the amount of surface spreading of the dye relative to that obtained by radiant heating, thus producing a sharper image.

These and other objects are achieved in accordance with this invention which comprises a process of fusing a dye-receiving element for thermal dye transfer suitable for forming a slide for projection viewing, the dye-receiving element comprising a polymeric central dye image-receiving section and a polymeric frame section extending around the periphery of the central section, the dye image-receiving section containing a thermally-transferred dye image, the process comprising simultaneously subjecting the element to both conductive and convective heating.

By use of the process of the invention, the problems encountered with the prior art described above can be substantially reduced. The process of the invention fuses the transferred dye into the receiver polymer or receiver layer by conductive and convective heating, which thereby substantially reduces the amount of surface spreading of the dye relative to that obtained by radiant heating. The heating can be obtained by use of a fusing device which allows the entire slide to come to the glass transition temperature of the polymeric receiver or slide frame, thus reducing the temperature lag between the dye and the slide, which in turn reduces the surface spreading of the dye. Since the dye has a better opportunity to diffuse into the polymeric material, images are sharper and there is less broadening of the lines during fusing.

The invention also comprises a process of forming a fused thermal dye transfer imaged slide element comprising a) imagewise-heating a dye-donor element comprising a support having thereon a dye layer, b) transferring portions of the dye layer to a dye-receiving element comprising a polymeric central dye image-receiving section and a polymeric frame section extending around the periphery of said central section, and c) simultaneously subjecting said element to both conductive and convective heating.

The invention further comprises an imaged slide element obtained from the process of the invention.

A detailed description of the invention is given below with reference to the drawings, wherein.

Figure 1:
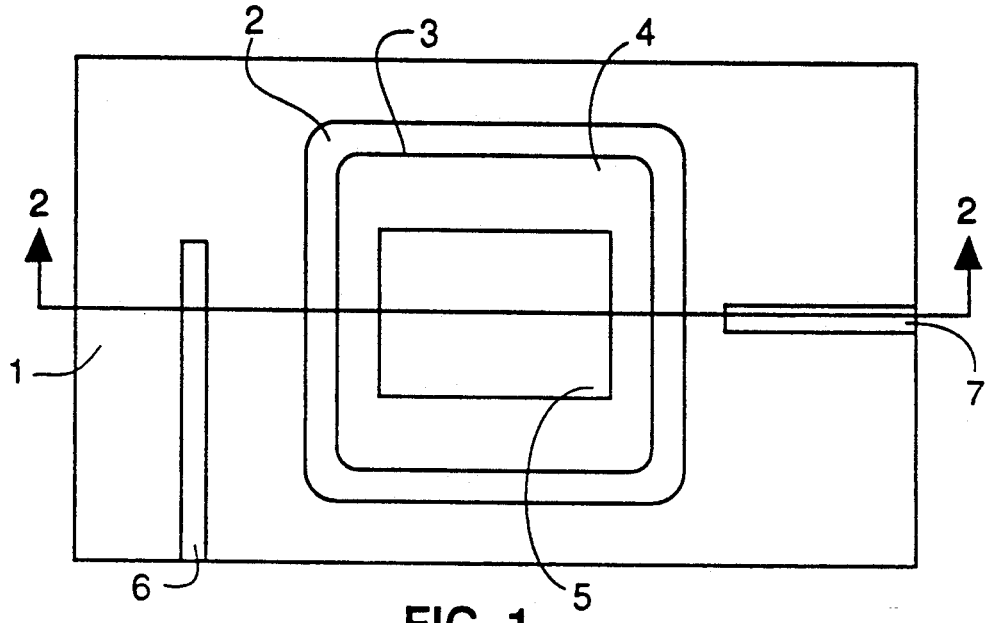
FIG. 1 is a top view of a fusing apparatus containing a slide with the upper heating element being omitted.
Figure 2:
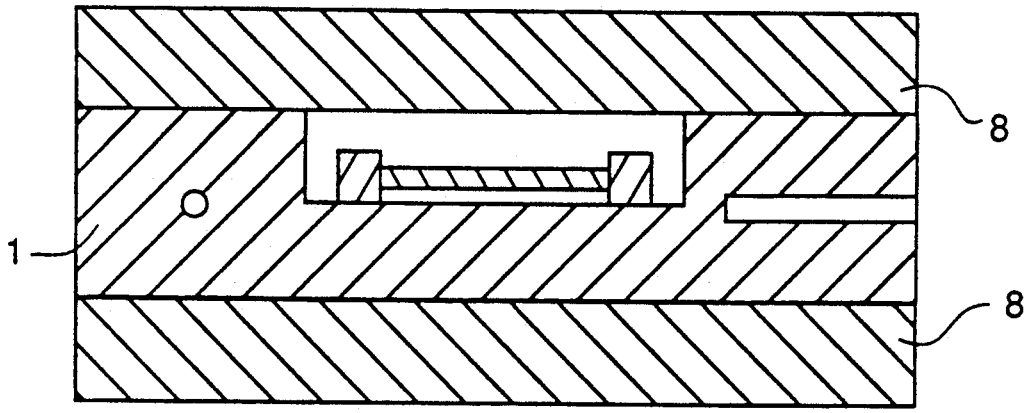
FIG. 2 is a cross-sectional view, taken along line "A"—"A" of FIG. 1, of the apparatus and slide illustrated in FIG. 1.

The slide fusing device employed in the process of the invention consists of slide holder 1, such as an aluminum block, sandwiched between two heating elements 8. The heating elements are designed to provide a uniform temperature over the top and bottom surfaces of the aluminum block. Space 6 is made in the block for a thermometer probe and space 7 for a temperature controller sensor. The sensor is connected to an appropriate circuit for maintaining the temperature at set-point +/− five degrees.

The aluminum block provides thermal mass to the system improving the control. The aluminum plate is hollowed out with cavity 2 to prevent the heating elements from physically touching the image surface of the slide which would cause mechanical damage to the image before fusing. Heat is transferred from the aluminum block to frame 4 of an integral injection-molded slide 3 which touches the block primarily by conduction and to image area 5 of slide 3 by convection. For conductive/convective fusing, the slide is placed in the aluminum block for an appropriate time after constant temperature has been attained. The slide is then removed and allowed to cool.

Although the invention has been described above for integral injection-molded slides as receiver elements, i.e., slides made from the same material in the image-receiving area as well as the frame, a slide patterned after conventional photographic slides, with a coated receiver film base strip mounted in a polymeric slide frame may, of course, also be subjected to fusing according to the invention.

In a preferred embodiment of the invention, an integral receiver-frame format is used as described in U.S. Ser. No. 722,810, filed Jun. 19, 1991, of Sarraf et al, now U.S. Pat No. 5,234,886. This element comprises a dye-image receiving section and frame section that permits thermal dye-transfer images to be made directly on an integral unit that is projectable. No separate step of mounting or assembling of the transferred image is required. The receiver-frame is of a size suitable for use in a slide projector. Most commercially available slide projectors are designed to accommodate conventional photographic slide frames which are approximately 50 mm by 50 mm. The central dye image-receiving section length and width dimensions are selected to provide sufficient area for forming a desired image, while still maintaining a sufficient peripheral frame width such that the integral receiver-frame exhibits adequate dimensional stability and sufficient frame area so that the receiver-frame may be handled without damaging the central dye image-receiving section. Central area widths and lengths of from about 20 mm to about 40 mm are preferred for slides with overall lengths and widths of about 50 mm. For consistency with conventional photographic slides, lengths of about 35 mm and widths of about 23 mm are particularly preferred.

The integral receiver-frame of the invention may be produced by any technique known in the "plastics art", such as injection molding, vacuum forming, or the like. The integral receiver-frame is conveniently produced from thermoplastic polymers, copolymers or mixture of polymers that are moldable or extrudable and have the capability of accepting a thermally transferable dye. The central receiver section of the receiver-frame is preferably thinner than the frame section to minimize scratching if the receiver-frame were slid across a flat hard surface such as a table top. The thickness difference may be embodied by the center area for imaging being recessed below the frame border or the frame border may contain elevated ridges or protrusions. The receiver frame thickness should be from about ½ mm to about 3 mm thick, more preferably from about 1.5 mm to about 2.5 mm thick, to have the proper thickness and weight to drop in the gate of a slide projector. Preferred thickness for the central dye image-receiving section is from about 0.2 to about 2.0 mm. These integral receiver-frames are rigid enough to stack and to stay flat and in focus during projection.

Desirably, the frame section is substantially opaque (preferably having a transmission density of about 2.0 or greater) in order to minimize projected light flare. While the dye image-receiving section may be tinted to provide a uniform colored background for projected images, it is preferred that the dye image-receiving section be substantially transparent (e.g. having an optical transmission of 85% or greater) in order to maximize design flexibility for transferred images.

A variety of polymers are known to be suitable as receiving layers for thermal dye transfer using such techniques as laser, thermal head, or flash lamp. Within this broad class of polymers, those that are preferred for production of an integral receiver-frame, however, are more selective. For example, the polymers should be thermoplastic and meltable for casting or extrusion at a temperature between 100° and 350° C.

Among various polymers which may be used for the receiver, polycarbonates alone or in mixture with other polyesters and copolymers of polycarbonates and other polyesters are considered preferred. The term "polycarbonate" as used herein means a polyester of carbonic acid and a glycol and/or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis(oxyphenyl)-butane, 1,1-bis(oxyphenyl)cyclohexane, 2,2-bis(oxyphenyl)butane, etc. In a particularly preferred embodiment, a bisphenol-A polycarbonate having a number average molecular weight of at least about 25,000 is used. Examples of polycarbonates include General Electric LEXAN® Polycarbonate Resin and Bayer AG MACROLON 5700®. Other polymer classes, with suitable selection, considered practical include cellulose esters, linear polyesters, styrene-acrylonitrile copolymers, styrene-ester copolymers, urethanes, and polyvinyl chloride. Optionally, the central dye image-receiving section may also be coated with an additional dye image-receiving layer comprising a polymer particularly effective at accepting transferred dye, such as a poly(vinyl alcohol-cobutyral).

The dye-donor that is used in the process of the invention comprises a support having thereon a heat transferable dye-containing layer. The use of dyes in the dye-donor permits a wide selection of hue and color and also permits easy transfer of images one or more times to a receiver if desired. The use of dyes also allows easy modification of density to any desired level.

Any dye can be used in the dye-donor employed in the invention provided it is transferable to the dye-receiving layer by the action of the heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

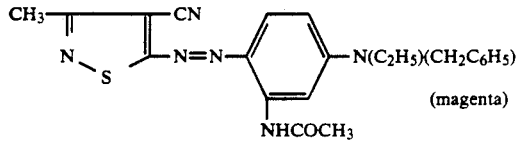

(magenta)

-continued

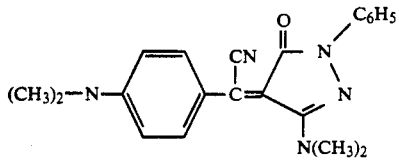

(magenta)

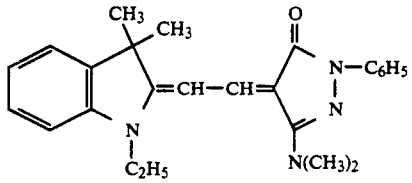

(yellow)

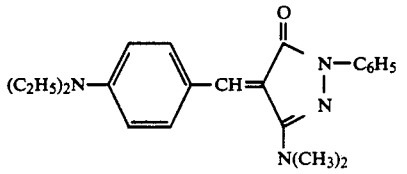

(yellow)

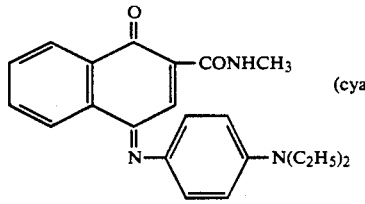

(cyan)

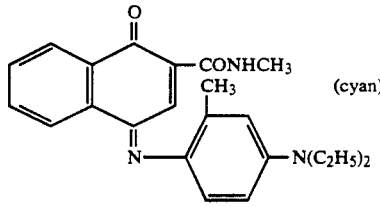

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination.

The dyes of the dye-donor element employed in the invention may be used at a coverage of from about 0.05 to about 1 g/m$^2$, and are dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate; poly(styrene-co-acrylonitrile); a poly(sulfone); a poly(vinyl alcohol-co-acetal) such as poly(vinyl alcohol-co-butyral) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat needed to transfer the sublimable dyes. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-cohexafluoropropylene); polyethers such as poly(oxymethylene); polyacetals; polyolefins such as polystyrene, polyethylene, polypropylene or methylpentane polymers; and polyimides such as polyimide-amides and polyether-imides. The support generally has a thickness of from about 2 to about 250 μm. It may also be coated with a subbing layer, if desired, such as those materials described in U.S. Pat. Nos. 4,695,288 or 4,737,486.

Various methods may be used to transfer dye from the dye donor to the receiver to form the imaged slide of the invention. There may be used, for example, a resistive head thermal printer as is well known in the thermal dye transfer art. There may also be used a high intensity light flash technique with a dye-donor containing an energy absorptive material such as carbon black or a light-absorbing dye. Such a donor may be used in conjunction with a mirror which has a pattern formed by etching with a photoresist material. This method is described more fully in U.S. Pat. No. 4,923,860, and is preferred when multiple slides having identical images are desired.

In a further preferred embodiment of the invention, the imagewise-heating is done by means of a laser using a dye-donor element comprising a support having thereon a dye layer and an absorbing material for the laser, the imagewise-heating being done in such a way as to produce a desired pattern of colorants. The use of lasers to image-wise heat dye donors to form an imaged slide is particularly desirable as lasers enable greater image resolution than other heat sources, which is particularly useful when working with the relatively small image area of a slide element.

Several different kinds of lasers could conceivably be used to effect the thermal transfer of dye from a donor sheet to the dye-receiving element to form the imaged slide of the invention, such as ion gas lasers like argon and krypton; metal vapor lasers such as copper, gold, and cadmium; solid state lasers such as ruby or YAG; or diode lasers such as gallium arsenide emitting in the infrared region from 750 to 870 nm. However, in practice, the diode lasers offer substantial advantages in terms of their small size, low cost, stability, reliability, ruggedness, and ease of modulation.

Thus, in a preferred embodiment of the process of the invention, a dye image is transferred by imagewise heating a dye-donor containing an infrared-absorbing material with a diode laser to volatilize the dye, the diode laser beam being modulated by a set of signals which is representative of the shape and color of the desired image, so that the dye is heated to cause volatilization only in those areas in which its presence is required on the dye-receiver.

Lasers which can be used to transfer dye from the dye-donor element to the dye image-receiving element to form the imaged slide in a preferred embodiment of the invention are available commercially. There can be employed, for example, Laser Model SDL-2420-H2® from Spectrodiode Labs, or Laser Model SLD 304 V/W® from Sony Corp. Laser thermal dye transfer imaging devices suitable for use in the process of the invention are disclosed in U.S. Pat. Nos. 5,066,962 and 5,105,206, the disclosures of which are hereby incorporated by reference.

Any material that absorbs the laser energy or high intensity light flash described above may be used as the absorbing material such as carbon black or nonvolatile infrared-absorbing dyes or pigments which are well known to those skilled in the art. In a preferred embodiment of the invention, an infrared-absorbing dye is employed in the dye-donor element instead of carbon black in order to avoid desaturated colors of the imaged dyes from carbon contamination. The use of an absorbing dye also avoids problems of non-uniformity due to inadequate carbon dispersing. In a preferred embodiment, cyanine infrared absorbing dyes are employed as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared absorbing dye may be contained in the dye layer itself or in a separate layer associated therewith.

In the above process, multiple dye-donors may be used in combination to obtain as many colors as desired in the final image. For example, for a full-color image, four colors: cyan, magenta, yellow and black are normally used.

Spacer beads may be employed in a separate layer over the dye layer of the dye-donor in the above-described laser process in order to separate the dye-donor from the dye-receiver during dye transfer, thereby increasing its uniformity and density. That invention is more fully described in U.S. Pat. No. 4,772,582, the disclosure of which is hereby incorporated by reference. Alternatively, the spacer beads may be employed in or on the dye-receiver as described in U.S. Pat. No. 4,876,235, the disclosure of which is hereby incorporated by reference. The spacer beads may be coated with a polymeric binder if desired.

The dye-donor element employed in the invention may be used in sheet form or in a continuous roll or ribbon. If a continuous roll or ribbon is employed, it may have alternating areas of different dyes or dye mixtures, such as sublimable cyan and/or yellow and/or magenta and/or black or other dyes.

The following examples are provided to further illustrate the invention.

EXAMPLE 1

The first magenta dye illustrated above was dispersed in an aqueous medium containing the following surfactant: A2 Triton® X-200 (Union Carbide Corp.). The exact formulation is shown in Table 1

TABLE 1

| COMPONENT | QUANTITY (grams) |
|---|---|
| Magenta Dye | 250 |
| 18.2% aq. Triton® X-200 A2 Dispersing Agent | 275 |
| Distilled Water | 476 |

The formulation, as shown in Table I, was milled at 16° C. in a 1-liter media mill (Model LME1, Netzsch Inc.) filled to 75% by volume with 0.4 to 0.6 mm zirconia silica medium (obtainable from Quartz Products Corp., SEPR Division, Plainfield N.J.). The slurry was milled until a mean near infrared turbidity measurement indicated the particle size to have been less than or equal to 0.2 μm by discrete wavelength turbidimetry.

This corresponded to a milling residence time of 45-90 minutes.

An aqueous carbon black (infrared-absorbing species) dispersion was prepared in a similar manner according to the formulation shown in Table II.

TABLE II

| Carbon Black Dispersion | |
|---|---|
| COMPONENT | QUANTITY (grams) |
| Carbon Black (Black Pearls 430 from Cabot Chemical Co.) | 200 |
| 18.2% aq. Triton ® X-200 A2 Dispersing Agent | 165 |
| Distilled Water | 635 |

A poly(ethylene terephthalate) support was coated with 0.57 g/m$^2$ of the magenta dye dispersion, 0.22 g/m$^2$ of the carbon black dispersion, and 1.08 g/m$^2$ of de-ionized bovine gelatin (Type IV), coated from water at 4.325% solids. Setting of the gelatin was accomplished by an initial chill to 4.4° C. prior to drying (23.9° C. to 60° C.). Cyan and yellow elements were made in a similar manner to the magenta element above using the first cyan and first yellow dyes illustrated above.

Dye-receiving elements were prepared using injection-molded slides of Lexan ® SP1010 (General Electric Company) bisphenol A polycarbonate as described in U.S. Ser. No. 722,810, filed Jun. 19, 1991, of Sarraf et al., now U.S. Pat. No. 5,234,886, discussed above.

Dye images were produced as described below by printing the dye-donor sheets onto the dye receiver using a laser imaging device similar to the one described in U.S. Ser. No. 457,595 of Sarraf et al, filed Dec. 27 1989, entitled "Thermal Slide Laser Printer", now U.S. Pat. No. 5,105,206. The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum grooves. The platen was attached to a moveable stage the position of which was controlled by a lead screw which determined the y axis position of the image. The dye-receiver was held tightly to the platen by means of the vacuum grooves, and each dye-donor element was held tightly to the dye-receiver by a second vacuum groove.

The laser beam had a wavelength of 830 nm and a power output of 37 mWatts at the platen. The measured spot size of the laser beam was an oval of nominally 7 by 9 microns (with the long dimension in the direction of the laser beam sweep). The center-to-center line distance was 10 microns (2941 lines per inch) with a laser scanning speed of 26.9 Hz.

Imaged slides were made using lines of different widths passing over areas of varying density. One imaged slide was fused in a radiant fuser for 47 seconds at a final temperature of 190° C., as described in U.S. Pat. No. 5,105,064. Another similarly imaged slide was fused for 90 seconds in the conductive/convective fuser described above which had been equilibrated to 150° C. The slides were removed from the respective fusers and the thickness of narrow, medium and wide lines was measured from photomicrographs made of the samples. The results are shown in Table III as follows:

TABLE III

| Linewidth | Thickness After Radiant Fusing | Thickness After Conductive/ Convective Fusing |
|---|---|---|
| Narrow | 102 μm | 74 μm |
| Medium | 154 μm | 90 μm |
| Wide | 179 μm | 128 μm |

The above results indicate that the linewidths for a narrow, medium, and wide line after conductive-convective fusing are significantly less than those obtained after radiant fusing. Since the dyes and slide surface are heated up at a more equal rate using conductive-convective fusing, less time elapses between the melting of the dyes and the onset of rapid diffusion into the polymeric receiver material at the glass transition point which causes less line spreading.

In another test, the width of a magenta and cyan line on a light grey background before radiant fusing was measured as 51 μm. After radiant fusing, the width of the line had increased to 86 μm, representing an increase of 69%. The increase represents diminished image quality.

EXAMPLE 2

Measuring Fusing Uniformity by Dye Extraction

A measure of uniformity can be obtained by extracting dye from the slide with a non-solvent for the polymer after fusing is complete. The extracting material should be a solvent for the dye.

It is believed that non-uniformity of fusing is highest at the corners of an image which are adjacent to the thicker frame area on two sides. The increased thermal mass in the frame acts as a heat sink in the case of radiant fusing where only the image and the slide area directly under the image are heated, i.e., there is a large thermal gradient between the corner of the image and the corner of the frame.

The extraction was performed using methanol at room temperature for 30 minutes on the slides of Example 1. The slide was removed from the methanol, dried, and the image examined for areas of decreased dye density; such areas indicate poor or incomplete fusing. Status A red, green, and blue densities were measured for each of the slides at the center and corner areas in order to show nonuniformity of the image areas for slides fused at the conditions listed in Table IV. The following results were obtained:

TABLE IV

| Transmission Densities After Methanol Extraction | | | | |
|---|---|---|---|---|
| Convective-Conductive Fusing Temp °C./Time (sec) | Status A visual | Status A red | Status A green | Status A blue |
| MIDDLE DENSITY | | | | |
| 140/120 | 1.43 | 1.55 | 1.58 | 1.52 |
| 150/90 | 1.48 | 1.61 | 1.63 | 1.60 |
| 150/105 | 1.48 | 1.62 | 1.61 | 1.58 |
| 160/60 | 1.41 | 1.54 | 1.56 | 1.51 |
| 160/75 | 1.48 | 1.62 | 1.62 | 1.59 |
| 170/45 | 1.51 | 1.65 | 1.65 | 1.63 |
| Radiant 47 sec Fusing | 1.46 | 1.61 | 1.58 | 1.54 |
| CORNER DENSITY | | | | |
| 140/120 | 2.47 | 2.57 | 2.88 | 2.58 |
| 150/90 | 2.48 | 2.58 | 2.90 | 2.61 |
| 150/105 | 2.50 | 2.58 | 2.92 | 2.63 |
| 160/60 | 2.46 | 2.57 | 2.85 | 2.55 |
| 160/75 | 2.47 | 2.60 | 2.86 | 2.60 |

TABLE IV-continued

| Transmission Densities After Methanol Extraction | | | | |
|---|---|---|---|---|
| Convective-Conductive Fusing Temp °C./Time (sec) | Status A visual | Status A red | Status A green | Status A blue |
| 170/45 | 2.49 | 2.59 | 2.91 | 2.61 |
| Radiant 47 sec Fusing | 2.36 | 2.38 | 2.79 | 2.43 |

The above results show similar values of density for the middle region of the slide for each fusing method. This indicates that the degree of dye fusing is comparable for both techniques in this region. However, as one compares the density values at the corner of the slide, it is apparent that the densities of slides after conductive/-convective fusing are higher than those after radiant fusing in all cases. The results indicate that the degree of fusing for the slides which had conductive/convective fusing is more complete at the corners than for the slides which had radiant fusing.

The invention has been described in detail with particular reference to preferred embodiments thereof, but it will be understood that variations and modifications can be effected within the spirit and scope of the invention.

What is claimed is:

1. A process of fusing a dye-receiving element for thermal dye transfer -suitable for forming a slide for projection viewing, said dye-receiving element comprising a polymeric central dye image-receiving section and a polymeric frame section extending around the periphery of said central section, said dye image-receiving section containing a thermally-transferred dye image, said process comprising simultaneously subjecting said element to both conductive and convective heating.

2. The process of claim 1 wherein said polymeric central dye image-receiving section and said polymeric frame section are made out of the same material.

3. The process of claim 2 wherein said material is a polycarbonate.

4. The process of claim 1 wherein said heating step is performed using an apparatus comprising a slide holder sandwiched between two heating elements.

5. The process of claim 4 wherein said slide holder is an aluminum block containing a cavity for said slide.

6. The process of claim 1 wherein said central dye image-receiving section is from about 0.2 to about 2 mm thick.

7. The process of claim 1 wherein said frame section is from about 1.5 to about 2.5 mm thick.

8. The process of claim 1 wherein said frame section is substantially opaque.

9. The process of claim 1 wherein said central dye image-receiving section is substantially transparent.

10. The process of claim 1 wherein external dimensions of said frame section are about 50 mm by 50 mm.

11. A process of forming a fused thermal dye transfer imaged slide element comprising a) imagewise-heating a dye-donor element comprising a support having thereon a dye layer, b) transferring portions of the dye layer to a dye-receiving element comprising a polymeric central dye image-receiving section and a polymeric frame section extending around the periphery of said central section, and c) simultaneously subjecting said element to both conductive and convective heating.

12. The process of claim 11 wherein said polymeric central dye image-receiving section and said polymeric frame section are made out of the same material.

13. The process of claim 12 wherein said material is a polycarbonate.

14. The process of claim 11 wherein said heating step is performed using an apparatus comprising a slide holder sandwiched between two heating elements.

15. The process of claim 14 wherein said slide holder is an aluminum block containing a cavity for said slide.

16. The process of claim 11 wherein a dye image is transferred by imagewise heating a dye-donor element containing an infrared-absorbing material with a diode laser to volatilize dye in the dye layer, the diode laser beam being modulated by a set of signals representative of the shape and color of a desired image.

17. The process of claim 16 wherein said infrared-absorbing material is an infrared absorbing dye.

18. An imaged slide obtained by the process of claim 16.

19. The process of claim 11 wherein said frame section is substantially opaque.

20. An imaged slide obtained by the process of claim 11.

* * * * *